United States Patent [19]

Hwang

[11] Patent Number: 4,898,312

[45] Date of Patent: Feb. 6, 1990

[54] CASSETTE TAPE HOLDING BOX AND DISPENSER

[76] Inventor: Harrison Hwang, No. 23, Lin Tsuo Road, Shankang, Taichung Hsien, Taiwan

[21] Appl. No.: 222,927

[22] Filed: Jul. 22, 1988

[51] Int. Cl.[4] ..... B26F 3/02; B65D 85/676

[52] U.S. Cl. ..... 225/26; 225/47; 225/77

[58] Field of Search ..... 225/26, 42, 45–51, 225/59, 77, 66, 90, 91; 206/53–55, 402–406, 409, 411, 603, 813, 824

[56] References Cited

U.S. PATENT DOCUMENTS

| | | | |
|---|---|---|---|
| 2,414,333 | 1/1947 | Schieman | 225/45 |
| 2,663,510 | 12/1953 | Rodgers | 225/65 |
| 2,776,095 | 1/1957 | Emmert | 242/55.53 |
| 3,187,968 | 6/1965 | Farre | 206/398 |
| 3,913,786 | 10/1975 | Kartasuk | 206/409 |
| 4,060,444 | 11/1977 | Schweig, Jr. et al. | 225/90 |
| 4,417,677 | 11/1983 | Mead | 225/53 |

FOREIGN PATENT DOCUMENTS

| | | | |
|---|---|---|---|
| 535182 | 12/1951 | Canada | 206/389 |
| 1237354 | 9/1965 | Fed. Rep. of Germany | 206/389 |
| 377091 | 7/1907 | France | 225/66 |
| 3705 | 1/1909 | United Kingdom | 206/389 |

*Primary Examiner*—Hien H. Phan

[57] ABSTRACT

A portable holder and dispenser for adhesive or pressure sensitive tape comprising a receptacle for containing a roll of tape, an opening being provided in the top panel of the receptacle for dispensing the tape, and a tape holder adapted for insertion into the bottom portion of the receptacle, the top panel being provided with serrations for engaging the adhesive surface of the tape.

4 Claims, 5 Drawing Sheets

100
111
112
113
150
110
14
15
11
13
12
143
142
130
132
141
144
133
140
1
131
134
31
30
21
240
24
23
241
2
230
22
231
20

CASSETTE TAPE HOLDING BOX AND DISPENSER

BACKGROUND OF THE INVENTION

This invention relates to the field of portable holding box and dispensers for adhesive or pressure-sensitive tape.

It is well known in the art to provide receptacles or containers for pressure-sensitive tape, e.g. transparent or other thin plastic or paper tape, which containers are equipped with a cutting device, typically a flat element having plastic or metal teeth suitable for tearing the tape. Typically, such prior art devices are designed so that a roll of tape can be positioned in them, and when it is desired to use a portion of the tape, the user unrolls a desired segment of tape and then draws the tape across the cutting edge, severing the segment from the remainder of the roll. This leaves an end portion of tape extending from the unused or stored edge to the cutting edge. After use of the dispenser, such an end portion is left suspended only on the teeth of the cutting edge. Consequently, the suspended portion often comes loose from the teeth and falls back onto the roll and adheres thereto. This makes it necessary for the user to find the end where it adheres to the roll and disengage or free a portion of it for grasping each time the device is used. Also, when the suspended portion falls back against the roll, it may be in a wrinkled or distorted configuration or it may contact an inner wall of the container, such that, in either case, the adhesive characteristics of the segment are reduced or destroyed. This makes it necessary to sever and discard the ruined portion before the device is next used.

The problem of having the end of the tape suspended only on the teeth of the cutting edge can be eliminated by running the portion over a wide flat surface between the stored roll and the cutting edge. With this kind of device, the segment of tape running from the unused roll to the cutting edge will contact and adhere to the wide surface sufficiently securely to keep it from falling back into the dispenser and adhering to the roll or to the inner walls. Unfortunately, when the tape is stored in this manner, i.e., in contact with a wide supporting surface between the roll and the cutting edge, this also may ruin the adhesive characteristics of the contact portion of the tape when it is pulled loose from the wide surface. Also, this type of device will make it difficult for the user to grasp the end portion of the tape, and typically, one will have to scrape the tape loose from the wide surface, again destroying a segment, which will have to be discarded before the remainder can be used.

Lack of structural rigidity is still another problem with prior art tape dispensers. It is highly desirable to make dispensers from inexpensive paperboard or cardboard so that they can be discarded after the tape is consumed. However, for such inexpensive dispensers the structures are often torn or damaged long before the roll of tape is consumed. When the cutting edge is supported on paperboard or cardboard of that type, it is often difficult to use it or tear the tape, since the structure is not sufficiently rigid to resist deformation.

There has been a long felt need for an inexpensive disposable dispenser which is sufficiently sturdy to be durable and long-wearing. It is also desirable to provide such a dispenser that is designed to provide a means for allowing the user to grip the end of the tape for pulling it from the roll without the necessity of scraping it loose from either the body of the dispenser or from the roll of tape itself. It is also desirable that such a dispenser be provided with a means for supporting the end portion of the tape when the dispenser is not in use, so that the end portion will not adhere so tightly that its adhesive qualities are diminished when it is pulled loose for use.

These and other objects are achieved in accordance with the present invention.

SUMMARY OF THE INVENTION

This invention contemplates a tape holding box and dispenser in the general form of a rectangular parallelepiped for holding and dispensing adhesive tape from a tubular roll. The box and dispenser comprise a receptacle made of plastic having an open bottom portion, an aligned parallel pair of front and rear walls, an aligned parallel pair of substantially rectangular side walls with an opening or hole in it, a top panel connecting corresponding segments of the upper edge of the side walls, the front walls and the rear walls and a tape holding base which can be inserted into the open bottom portion of the receptacle, the top panel and side walls defining an opening for dispensing tape from the roll, and cutting means placed on the upper edge of the front wall for cutting the tape.

The upper surface between the front edge and the opening on the top panel for dispensing tape is formed with at least one wall of serrations which serves as an easy-release planar retaining surface for releasably securing the tape when the dispenser is not in use, and a positioning member for maintaining the end portion of the tape at a low acute angle relative to the planar retaining surface.

A more complete understanding of these and other features and advantages of the present invention will become apparent from a careful consideration of the following detailed description of certain embodiments illustrated in the accompanying drawings.

DETAILED DESCRIPTION OF THE INVENTION

Figure 1:
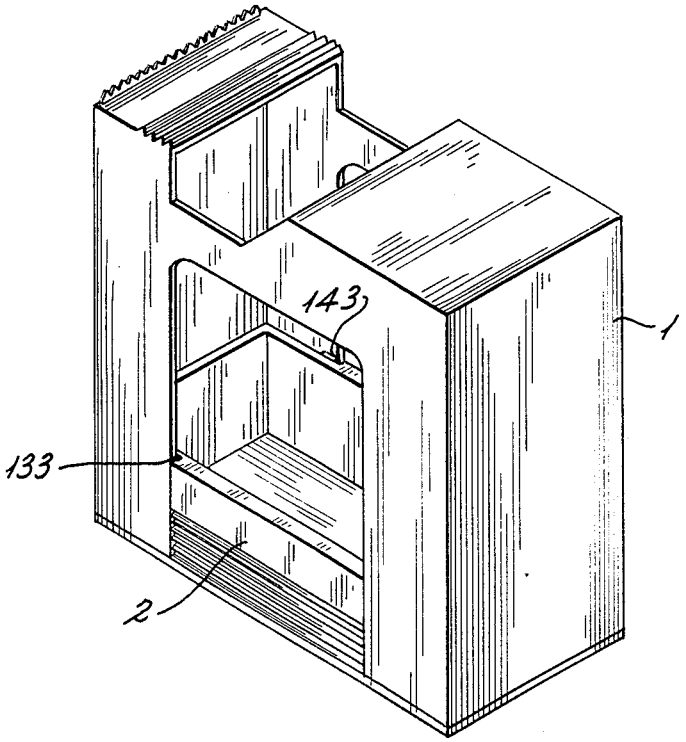
FIG. 1 is a perspective view showing a fully assembled preferred example of the invention.
Figure 2:
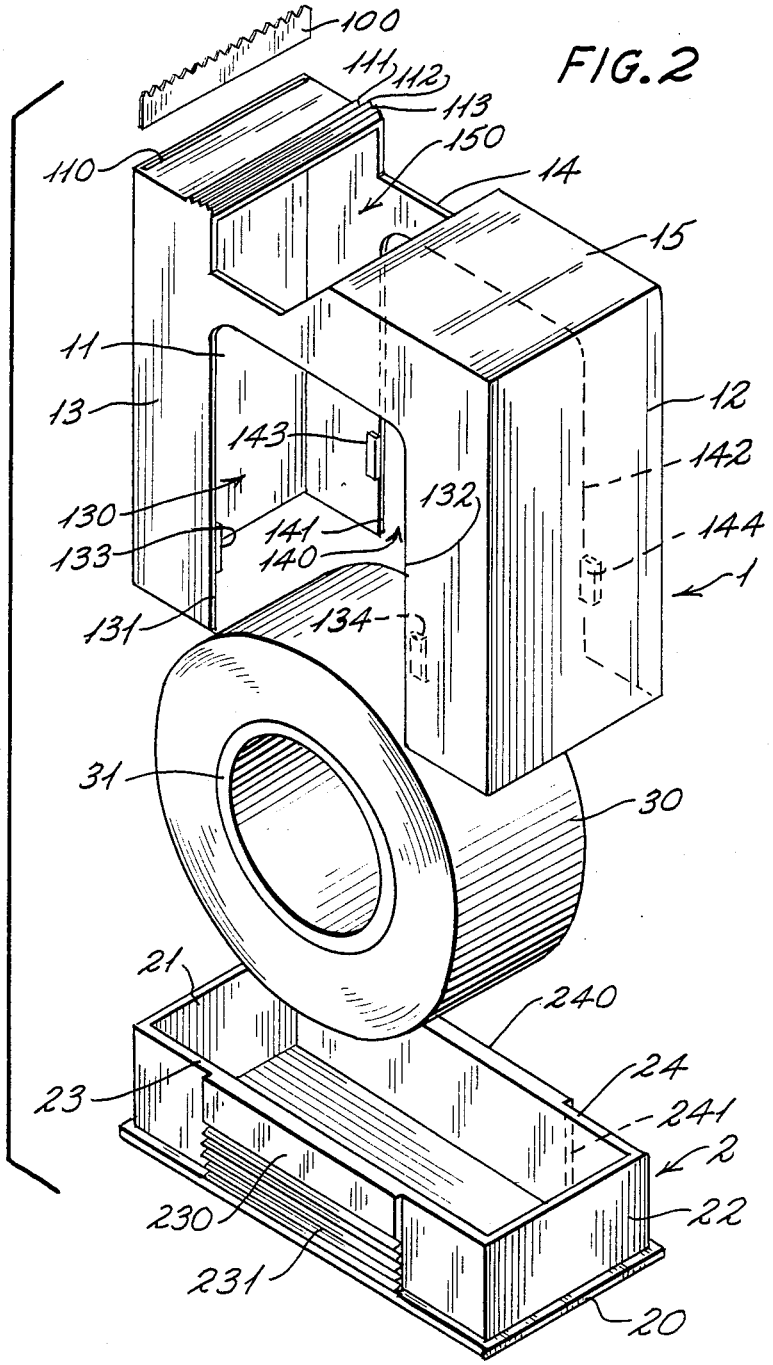
FIG. 2 is an exploded perspective view showing the components of the invention of FIG. 1.

Referring to FIGS. 1 and 2 of the drawings, there is shown a generally parallelepiped receptacle 1 open at the bottom. The receptacle 1 is formed from a pair of aligned parallel front and rear walls 11, 12, and another pair of aligned parallel side walls 13, 14, and a top panel 15 running transversely between corresponding segment of the upper edges of the side walls. The receptacle 1 is sized for enclosing and containing a tape roll 30 on a core or spool 31, the axis of the core running perpendicular to the side walls. On each of the side walls 13, 14, there is a hole or an opening 130, 140 which extends from its lower edge to its central part respectively. On each of the inner side edges 131, 132, 141, 142 of the opening 130, 140, there is also a narrow block 133, 134, 143, 144 respectively. The top panel 15 and side walls 13, 14 also defining an opening 150 for dispensing tape from the wall. On the upper edge of the front wall 11, there is also a furrow 110 for holding a cutting means 100. The upper surface of the top panel 15 between furrow 110 and the opening 150 for dispensing tape from the wall then forms serrations 111,112,113.

In the preferred design of FIGS. 1 and 2, a desirable means for holding the tape roll within the receptacle 1 is shown, which is a tape holding base 2 formed of a bottom 20, a pair of front and rear walls 21, 22 and a pair of side walls 23, 24. The tape holding base is sized to match with the opening at the bottom of the receptacle 1, thus enabling the tape holding base to be inserted into the receptacle 1 and held firmly inside it by means of the narrow blocks 133, 134, 143, 144. The central parts of the side walls 23, 24 of the tape holding base 2 then form thick walls 230, 240. On the surfaces of the lower parts of the thicker walls 230, 240, a series of wave-form strips 231, 241 are formed which improve the appearance of the whole box and enable the user to pull down the tape holding base 2 easily. The length of the thicker walls 230, 240 is the same as the width of the opening 130, 140 formed on the side walls 13, 14 of the receptacle 1. The protruded thicknesses of the thicker walls 230, 240 are then the same as the thickness of the side walls 13, 14 of the receptacle 1. After the tape holding base 2 is placed into the receptacle 1, the narrow blocks 133, 134, 143, 144 press on the sides of the thicker walls 230, 240 and then keep the tape holding base inside the receptacle 1 firmly.

Figure 3:
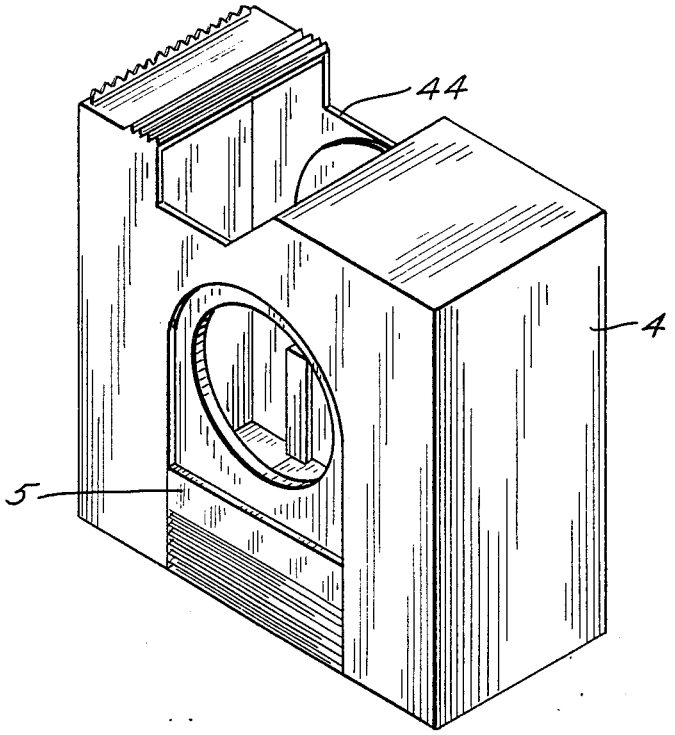
FIG. 3 is a perspective view showing another fully assembled preferred example of the invention.
Figure 4:
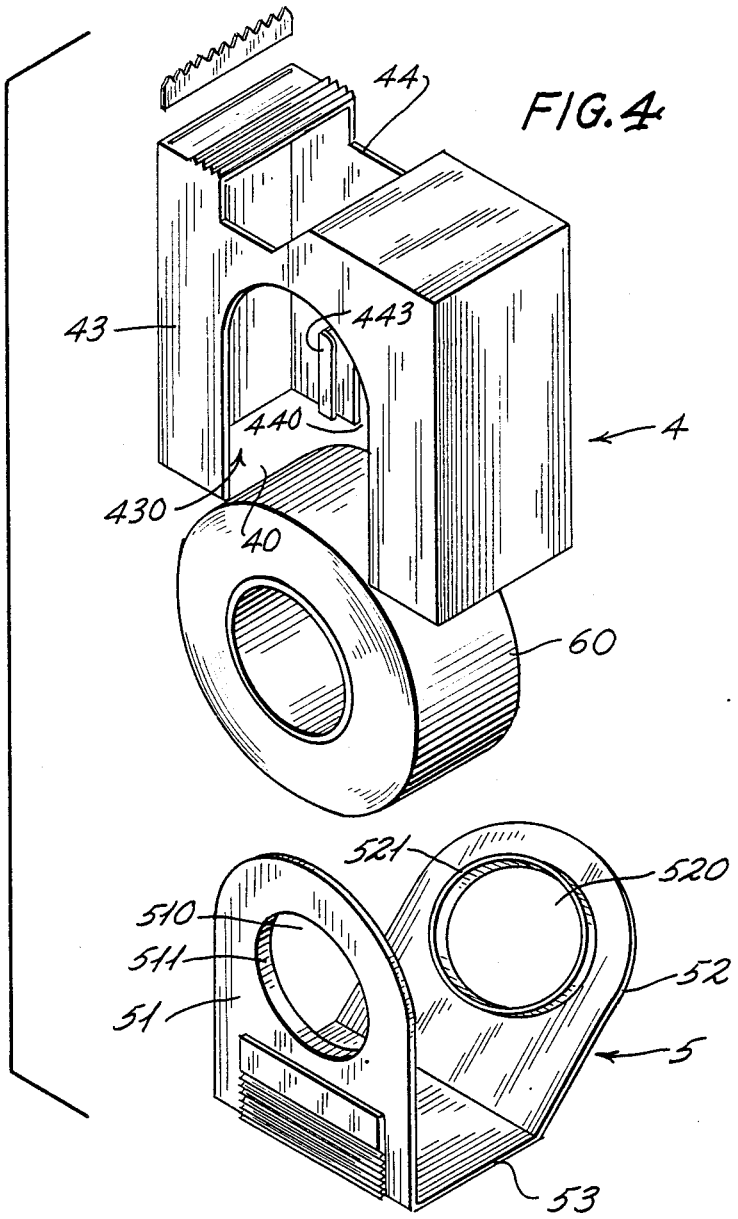
FIG. 4 is an exploded perspective view showing the components of the invention of FIG. 3.

As shown in FIGS. 3 and 4, the receptacle 4 of another preferred example of the invention is the same as shown in FIG. 2, but the upper edges of the opening 430, 440 formed on the side walls 43, 44 of the receptacles are in arc shape, and on each of the inner side edges of the openings 430, 440 there is an L-shaped plate 433, 434, 443, 444, respectively. Thus, between each of the plates 433, 434, 444, and one of the side walls 43, 44, there is a gap. Further as shown in FIG. 4, a tape holder 5 is used for holding the tape roll 60, which holder 5 is a piece of foldable plate and comprises a pair of upright side plates 51, 52 and a base plate 53 which links the side plates 51, 52, on the upright side plates 51, 52 of the holder 5. There are round-shaped holes 510, 520. On the inner edges of the holes 510, 520, ring-shaped walls 511, 521 are provided for supporting the tape roll 60 and for use as a rotational axis. As the holder 5 with tape roll 60 are put inside the receptacle 4 from its bottom opening 40, the edges of the side plates 51, 52 will be held firmly by the L-shaped plates 433, 434, 443 and 444.

Figure 5:
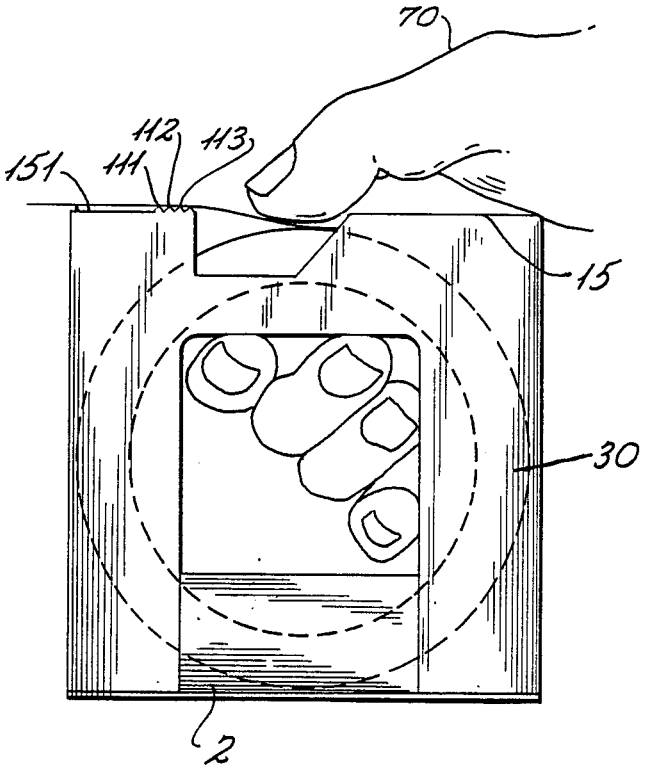
FIG. 5 is a side elevation view showing the position of the tape in use.

As shown in FIG. 5, in using this invention, the serrations 111, 112, 113 standing on the surface of the top panels 15 allow the segment of the tape 30 to be pressed down upon the embossed retaining surface 151 when the dispenser is not in use. To dispense a piece of tape, the user's hand 70 grips the dispenser with the fingers in the hole on the side wall of the receptacle, the thumb pressing down upon the tape roll 30 to stop rotation of the roll within the receptacle.

The unique characteristics of the invention permit it to perform consistently. Also, because the invention is made of plastic, its life always greatly exceeds the ordinary life of a roll of adhesive tape. Thus, if desired, the dispenser can be used over and over by removing the core or spool 31 from the dispenser and replacing it with a new roll of tape.

Many other uses and variations of the invention will be apparent to those skilled in the art and while specific embodiments of this invention have been described, these are intended for illustrative purposes only. It is intended that the scope of the invention be limited only by the attached claims.

What is claimed is:

1. A portable holder and dispenser for adhesive or pressure sensitive tape comprising a receptacle having an open bottom portion for containing a roll of tape, the receptacle being formed of a pair of aligned parallel front and rear walls, a pair of aligned parallel side walls and first and second spaced apart top panels separated by an opening and running transversely between corresponding segments of the upper edges of the side walls, a hole extending from the lower edge of each of the side walls to the central part thereof respectively, securing means being provided on each of the inner side edges of the hole to engage a tape holding base, the first top panel having on the upper, front edge thereof a furrow and on the upper edge adjacent the opening serrations for engaging the adhesive or pressure sensitive surface of the tape, cutting means adapted for insertion into the furrow, the tape holding base being adapted for insertion into the open bottom portion of the receptacle and comprising a pair of side plates and a base plate linking the side plates, each of the side plates having an opening on the inner edge thereof for holding the tape roll, and means for engaging the securing means in the receptacle to retain the tape holding base within the open bottom portion of the receptacle.

2. The holder and dispenser of claim 1 wherein the side plates are provided with serrations on the exterior surface thereof.

3. A portable holder and dispenser for adhesive or pressure sensitive tape comprising a receptacle for containing a roll of tape, the receptacle being formed of a pair of aligned parallel front and rear walls, a pair of aligned parallel side walls and first and second spaced apart top panels separated by an opening and running transversely between corresponding segments of the upper edges of the side walls, a hole extending from the lower edge of each of the side walls to the central part thereof respectively, hooking means being provided on each of the inner side edges of the hole to engage a tape holder, the first top panel having on the upper, front edge thereof a furrow and on the upper edge adjacent the opening serrations for engaging the adhesive or pressure sensitive surface of the tape, cutting means adapted for insertion into the furrow, the tape holder being adapted for insertion into an aperture defined by the side, front and back walls of the receptacle and comprising a pair of front and back walls, a pair of side plates and a base plate linking the side plates, each of the side plates having an opening on the outer edge thereof for holding the tape roll, and means for engaging the hooking means in the receptacle to retain the holder within the aperture.

4. The holder and dispenser of claim 3 wherein the side plates walls are provided with serrations on the exterior surface thereof.

* * * * *